US007602598B2

(12) United States Patent
Nerheim

(10) Patent No.: US 7,602,598 B2
(45) Date of Patent: Oct. 13, 2009

(54) SYSTEMS AND METHODS FOR IMMOBILIZING USING WAVEFORM SHAPING

(75) Inventor: Magne H. Nerheim, Paradise Valley, AZ (US)

(73) Assignee: TASER International, Inc., Scottsdale, AZ (US)

( * ) Notice: Subject to any disclaimer, the term of this patent is extended or adjusted under 35 U.S.C. 154(b) by 0 days.

(21) Appl. No.: 11/566,481

(22) Filed: Dec. 4, 2006

(65) Prior Publication Data

US 2007/0109712 A1 May 17, 2007

Related U.S. Application Data

(63) Continuation of application No. 10/364,164, filed on Feb. 11, 2003, now Pat. No. 7,145,762.

(51) Int. Cl.
*F41C 9/00* (2006.01)

(52) U.S. Cl. ..... 361/232; 42/1.08

(58) Field of Classification Search ..... 361/212, 361/230–232; 42/1.08; 463/47.2, 47.3
See application file for complete search history.

(56) References Cited

U.S. PATENT DOCUMENTS

| | | | |
|---|---|---|---|
| 2,805,067 | A | 9/1957 | Ryan |
| 2,896,123 | A | 7/1959 | McNulty |
| 3,223,887 | A | 12/1965 | Brown |
| 3,376,470 | A | 4/1968 | Stone |
| 3,450,942 | A | 6/1969 | Segall |
| 3,523,538 | A | 8/1970 | Shimizu |
| 3,569,727 | A | 3/1971 | Aggarwal |
| 3,584,929 | A | 6/1971 | Schuette |
| 3,626,626 | A | 12/1971 | Blanc |
| 3,629,652 | A | 12/1971 | Maycock |
| 3,717,802 | A | 2/1973 | Plevy |
| 3,803,463 | A | 4/1974 | Cover |
| 3,819,108 | A | 6/1974 | Jordan |
| 3,869,645 | A | 3/1975 | Collins |
| 3,958,168 | A | 5/1976 | Grundberg |
| 3,972,315 | A | 8/1976 | Munden |

(Continued)

FOREIGN PATENT DOCUMENTS

| | | |
|---|---|---|
| EP | 228840 | 7/1987 |

(Continued)

OTHER PUBLICATIONS

U.S. Appl. No. 10/364,164, filed Feb. 11, 2003, Nerheim.

(Continued)

*Primary Examiner*—Danny Nguyen
(74) *Attorney, Agent, or Firm*—William R. Bachand

(57) ABSTRACT

An apparatus produces contractions in skeletal muscles of a target to impede locomotion by an animal of human target. The apparatus is used with at least one electrode for conducting a current through the target. The apparatus may be implemented as an electronic disabling device. The apparatus includes two circuits. The first circuit includes a transformer and a first capacitor. The second capacitor and a secondary winding of the transformer. The second circuit is a series circuit with the electrode. In operation with the electrode, the transformer impresses a voltage on the electrode of greater magnitude than the first voltage, and the current is responsive to the first capacitor and discharge of the second capacitor.

17 Claims, 13 Drawing Sheets

U.S. PATENT DOCUMENTS

| | | | | |
|---|---|---|---|---|
| 4,004,561 | A | | 1/1977 | Thieme |
| 4,027,198 | A | | 5/1977 | Linkroum |
| 4,040,425 | A | | 8/1977 | Goodling |
| 4,092,695 | A | | 5/1978 | Henderson |
| 4,120,305 | A | | 10/1978 | Rhoads |
| 4,129,895 | A | | 12/1978 | Witting |
| 4,154,205 | A | | 5/1979 | Forster |
| 4,162,515 | A | | 7/1979 | Henderson |
| 4,167,036 | A | | 9/1979 | Kenney |
| 4,242,715 | A | | 12/1980 | Laird |
| 4,253,132 | A | | 2/1981 | Cover |
| 4,370,696 | A | | 1/1983 | Darrell |
| 4,486,807 | A | | 12/1984 | Yanez |
| 4,510,915 | A | | 4/1985 | Ishikawa |
| 4,539,937 | A | | 9/1985 | Workman |
| 4,541,848 | A | | 9/1985 | Masuda |
| 4,589,398 | A | | 5/1986 | Pate |
| 4,613,797 | A | | 9/1986 | Eggers |
| 4,688,140 | A | | 8/1987 | Hammes |
| 4,691,264 | A | | 9/1987 | Schaffhauser |
| 4,755,723 | A | | 7/1988 | Sikora |
| 4,843,336 | A | | 6/1989 | Kuo |
| 4,846,044 | A | | 7/1989 | Lahr |
| 4,859,868 | A | | 8/1989 | McKissack |
| 4,872,084 | A | | 10/1989 | Dunning |
| 4,884,809 | A | | 12/1989 | Rowan |
| 4,900,990 | A | | 2/1990 | Sikora |
| 4,949,017 | A | | 8/1990 | Sikora |
| 5,060,131 | A | | 10/1991 | Sikora |
| 5,163,411 | A | | 11/1992 | Koiwa |
| 5,178,120 | A | | 1/1993 | Howson |
| 5,193,048 | A | | 3/1993 | Kaufman |
| 5,215,066 | A | | 6/1993 | Narishige |
| 5,225,623 | A | | 7/1993 | Krasnow |
| 5,282,332 | A | | 2/1994 | Philips |
| 5,317,155 | A | | 5/1994 | King |
| 5,388,603 | A | | 2/1995 | Bauer |
| 5,467,247 | A | | 11/1995 | de Anda |
| 5,471,362 | A | | 11/1995 | Gowan |
| 5,473,501 | A | | 12/1995 | Claypool |
| 5,519,389 | A | | 5/1996 | DeGunther |
| 5,523,654 | A | | 6/1996 | Sikora |
| 5,619,402 | A | | 4/1997 | Liu |
| 5,625,525 | A | | 4/1997 | Coakley |
| 5,654,868 | A | | 8/1997 | Buer |
| 5,698,815 | A | | 12/1997 | Ragner |
| 5,754,011 | A | * | 5/1998 | Frus et al. ..... 315/209 SC |
| 5,755,056 | A | | 5/1998 | Danner |
| 5,799,433 | A | | 9/1998 | Danner |
| 5,891,172 | A | * | 4/1999 | Stendahl et al. ..... 607/5 |
| 5,962,806 | A | | 10/1999 | Coakley |
| 5,973,477 | A | | 10/1999 | Chang |
| 6,204,476 | B1 | | 3/2001 | Reynolds |
| 6,237,461 | B1 | | 5/2001 | Poole |
| 6,404,613 | B1 | | 6/2002 | Dowling |
| 6,636,412 | B2 | | 10/2003 | Smith |
| 6,643,114 | B2 | | 11/2003 | Stethem |
| 6,679,180 | B2 | | 1/2004 | Warnagiris |
| 6,791,816 | B2 | | 9/2004 | Stethem |
| 6,862,994 | B2 | | 3/2005 | Chang |
| 6,877,434 | B1 | | 4/2005 | McNulty |
| RE38,794 | E | | 9/2005 | Danner |
| 6,999,295 | B2 | | 2/2006 | Watkins |
| 7,012,797 | B1 | | 3/2006 | Delida |
| 7,102,870 | B2 | | 9/2006 | Nerheim |
| 7,174,668 | B2 | | 2/2007 | Locklear |

FOREIGN PATENT DOCUMENTS

| | | |
|---|---|---|
| FR | 2317804 | 4/1977 |
| GB | 1109052 | 4/1968 |
| GB | 1239756 | 7/1971 |
| GB | 2085523 | 4/1982 |
| KR | 20-1994-0001616 | 1/1994 |
| KR | 10-1998-072970 | 11/1998 |
| WO | WO-98/11399 | 3/1998 |
| WO | WO-PCT/EP01/04862 | 11/2001 |

OTHER PUBLICATIONS

U.S. Appl. No. 10/447,447, filed May 29, 2003, Nerheim.
U.S. Appl. No. 11/285,945, filed Nov. 5, 2005, Nerheim.
U.S. Appl. No. 11/457,549, filed Jul. 14, 2006, Nerheim.
T'Prina Technology, "Stun Guns - An Independent Report," 1994.

* cited by examiner

| Interval Number | TIME | GAP1 | GAP 2 |
|---|---|---|---|
| 1 | $T_0 - T_1$ | OFF | OFF |
| 2 | $T_1 - T_2$ | ON | OFF |
| 3 | $T_2 - T_3$ | OFF | ON |
| 4 | $T_3 - T_4$ | OFF | OFF |

SPARK Gap ON/OFF Timing

SYSTEMS AND METHODS FOR IMMOBILIZING USING WAVEFORM SHAPING

CROSS-REFERENCE TO RELATED APPLICATIONS

This application is a continuation of and claims priority from U.S. patent application Ser. No. 10/364,164 filed Feb. 11, 2003 now U.S. Pat. No. 7,145,762 by Magne H. Nerheim.

FIELD OF THE INVENTION

The present invention relates to electronic disabling devices, and more particularly, to electronic disabling devices which generate a time-sequenced, shaped voltage waveform output signal.

BACKGROUND OF THE INVENTION

The original stun gun was invented in the 1960's by Jack Cover. Such prior art stun guns incapacitated a target by delivering a sequence of high voltage pulses into the skin of a subject such that the current flow through the subject essentially "short-circuited" the target's neuromuscular system causing a stun effect in lower power systems and involuntary muscle contractions in more powerful systems. Stun guns, or electronic disabling devices, have been made in two primary configurations. A first stun gun design requires the user to establish direct contact between the first and second stun gun output electrodes and the target. A second stun gun design operates on a remote target by launching a pair of darts which typically incorporate barbed pointed ends. The darts either indirectly engage the clothing worn by a target or directly engage the target by causing the barbs to penetrate the target's skin. In most cases, a high impedance air gap exists between one or both of the first and second stun gun electrodes and the skin of the target because one or both of the electrodes contact the target's clothing rather than establishing a direct, low impedance contact point with the target's skin.

One of the most advanced existing stun guns incorporates the circuit concept illustrated in the FIG. 1 schematic diagram. Closing safety switch S1 connects the battery power supply to a microprocessor circuit and places the stun gun in the "armed" and ready to fire configuration. Subsequent closure of the trigger switch S2 causes the microprocessor to activate the power supply which generates a pulsed voltage output on the order of 2,000 volts which is coupled to charge an energy storage capacitor up to the 2,000 volt power supply output voltage. Spark gap GAP1 periodically breaks down, causing a high current pulse through transformer T1 which transforms the 2,000 volt input into a 50,000 volt output pulse.

Taser International of Scottsdale, Ariz. the assignee of the present invention, has for several years manufactured sophisticated stun guns of the type illustrated in the FIG. 1 block diagram designated as the Taser® Model M18 and Model M26 stun guns. High power stun guns such as these Taser International products typically incorporate an energy storage capacitor having a capacitance rating of from 0.2 microfarads at 2,000 volts on a light duty weapon up to 0.88 microfarads at 2,000 volts as used on the Taser M18 and M26 stun guns.

After the trigger switch S2 is closed, the high voltage power supply begins charging the energy storage capacitor up to the 2,000 volt power supply peak output voltage. When the power supply output voltage reaches the 2,000 volt spark gap breakdown voltage, a spark is generated across the spark gap designated as GAP 1. Ionization of the spark gap reduces the spark gap impedance from a near infinite impedance level to a near zero impedance and allows the energy storage capacitor to almost fully discharge through step up transformer T1. As the output voltage of the energy storage capacitor rapidly decreases from the original 2,000 volt level to a much lower level, the current flow through the spark gap decreases toward zero causing the spark gap to deionize and to resume its open circuit configuration with a near infinite impedance. This "reopening" of the spark gap defines the end of the first 50,000 volt output pulse which is applied to output electrodes designated in FIG. 1 as "El" and "E2". A typical stun gun of the type illustrated in the FIG. 1 circuit diagram produces from 5 to 20 pulses per second.

Because a stun gun designer must assume that a target may be wearing an item of clothing such as a leather or cloth jacket which functions to establish a 0.25 inch to 1.0 inch air gap between stun gun electrodes E1 and E2 and the target's skin, stun guns have been required to generate 50,000 volt output pulses because this extreme voltage level is capable of establishing an arc across the high impedance air gap which may be presented between the stun gun output electrodes E1 and E2 and the target's skin. As soon as this electrical arc has been established, the near infinite impedance across the air gap is promptly reduced to a very low impedance level which allows current to flow between the spaced apart stun gun output electrodes E1 and E2 and through the target's skin and intervening tissue regions. By generating a significant current flow within the target across the spaced apart stun gun output electrodes, the stun gun essentially short circuits the target's electromuscular control system and induces severe muscular contractions. With high power stun guns, such as the Taser M18 and M26 stun guns, the magnitude of the current flow across the spaced apart stun gun output electrodes causes numerous groups of skeletal muscles to rigidly contract. By causing high force level skeletal muscle contractions, the stun gun causes the target to lose its ability to maintain an erect, balanced posture. As a result, the target falls to the ground and is incapacitated.

The "M26" designation of the Taser stun gun reflects the fact that, when operated, the Taser M26 stun gun delivers 26 watts of output power as measured at the output capacitor. Due to the high voltage power supply inefficiencies, the battery input power is around 35 watts at a pulse rate of 15 pulses per second. Due to the requirement to generate a high voltage, high power output signal, the Taser M26 stun gun requires a relatively large and relatively heavy 8 AA cell battery pack. In addition, the M26 power generating solid state components, its energy storage capacitor, step up transformer and related parts must function either in a high current relatively high voltage mode (2,000 volts) or be able to withstand repeated exposure to 50,000 volt output pulses.

At somewhere around 50,000 volts, the M26 stun gun air gap between output electrodes E1 and E2 breaks down, the air is ionized, a blue electric arc forms between the electrodes and current begins flowing between electrodes E1 and E2. As soon as stun gun output terminals E1 and E2 are presented with a relatively low impedance load instead of the high impedance air gap, the stun gun output voltage will drop to a significantly lower voltage level. For example, with a human target and with about a 10 inch probe to probe separation, the output voltage of a Taser Model M26 might drop from an initial high level of 50,000 volts to a voltage on the order of about 5,000 volts. This rapid voltage drop phenomenon with even the most advanced conventional stun guns results because such stun guns are tuned to operate in only a single mode to consistently create an electrical arc across a very high, near infinite impedance air gap. Once the stun gun output electrodes actually form a direct low impedance circuit across the spark gap, the effective stun gun load impedance decreases to the target impedance-typically a level on the order of 1,000 ohms or less. A typical human subject frequently presents a load impedance on the order of about 200 ohms.

Conventional stun guns have by necessity been designed to have the capability of causing voltage breakdown across a very high impedance air gap. As a result, such stun guns have been designed to produce a 50,000 to 60,000 volt output. Once the air gap has been ionized and the air gap impedance has been reduced to a very low level, the stun gun, which has by necessity been designed to have the capability of ionizing an air gap, must now continue operating in the same mode while delivering current flow or charge across the skin of a now very low impedance target. The resulting high power, high voltage stun gun circuit operates relatively inefficiently yielding low electro-muscular efficiency and with high battery power requirements.

SUMMARY OF THE INVENTION

An apparatus produces contractions in skeletal muscles of a target to impede locomotion by an animal or human target. The apparatus is used with at least one electrode for conducting a current through the target. The apparatus may be implemented as an electronic disabling device. The apparatus includes two circuits. The first circuit includes a transformer and a first capacitor. The second circuit includes a second capacitor and a secondary winding of the transformer. The second circuit is a series circuit with the electrode. In operation with the electrode, the transformer impresses a voltage on the electrode of greater magnitude than the first voltage, and the current is responsive to discharge of the first capacitor and discharge of the second capacitor.

BRIEF DESCRIPTION OF THE DRAWING

The invention is pointed out with particularity in the appended claims. However, other objects and advantages together with the operation of the invention may be better understood by reference to the following detailed description taken in connection with the following illustrations, wherein:

DESCRIPTION OF THE PREFERRED EMBODIMENTS

In order to better illustrate the advantages of the invention and its contributions to the art, a preferred embodiment of the invention will now be described in detail.

Figure 2:
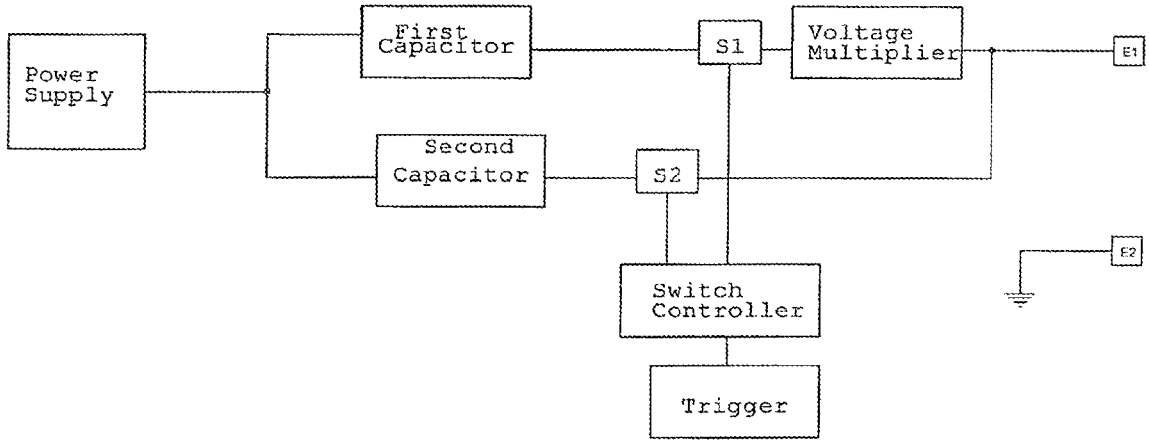
FIG. 2 represents a block diagram illustration of one embodiment of the present invention.

Referring now to FIG. 2, an electronic disabling device for immobilizing a target according to the present invention includes a power supply, first and second energy storage capacitors, and switches S1 and S2 which operate as single pole, single throw switches and serve to selectively connect the two energy storage capacitors to down stream circuit elements. The first energy storage capacitor is selectively connected by switch S1 to a voltage multiplier which is coupled to first and second stun gun output electrodes designated E1 and E2. The first leads of the first and second energy storage capacitors are connected in parallel with the power supply output. The second leads of each capacitor are connected to ground to thereby establish an electrical connection with the grounded output electrode E2.

The stun gun trigger controls a switch controller which controls the timing and closure of switches S1 and S2.

Referring now to FIGS. 3 through 8 and FIG. 12, the power supply is activated at time T0. The energy storage capacitor charging takes place during time interval T0-T1 as illustrated in FIGS. 12A and 12B.

At time T1, switch controller closes switch S1 which couples the output of the first energy storage capacitor to the voltage multiplier. The FIG. 3B and FIG. 6 voltage versus time graphs illustrate that the voltage multiplier output rapidly builds from a zero voltage level to a level indicated in the FIG. 3B and FIG. 6 graphs as "$V_{HIGH}$".

Figure 5A:
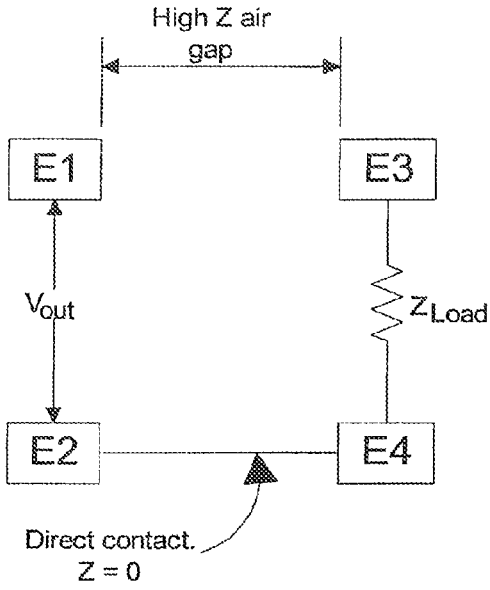
FIG. 5A illustrates a high impedance air gap which may exist between one of the electronic disabling device output electrodes and spaced apart locations on a target illustrated by the designations "E3", "E4", and an intervening load $Z_{LOAD}$.
Figure 5B:
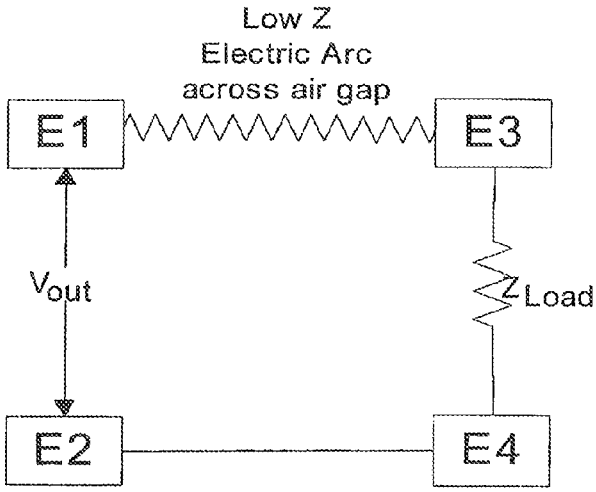
FIG. 5B illustrates the circuit elements shown in FIG. 5A after an electric spark has been created across electrodes E1 and E2 which produces an ionized, low impedance path across the air gap.

In the hypothetical situation illustrated in FIG. 5A, a high impedance air gap exists between stun gun output electrode E1 and target contact point E3. The FIG. 5A diagram illustrates the hypothetical situation where a direct contact (i.e., impedance E2-E4 equals zero) has been established between stun gun electrical output terminal E2 and the second spaced apart contact point E4 on a human target. The E1 to E2 spacing on the target is assumed to equal on the order of 10 inches. The resistor symbol and the symbol $Z_{LOAD}$ represents the internal target resistance which is typically less than 1,000 ohms and approximates 200 ohms for a typical human target.

Application of the $V_{HIGH}$ voltage multiplied output across the E1 to E3 high impedance air gap forms an electrical arc having ionized air within the air gap. The FIG. 5C timing diagram illustrates that after a predetermined time during the T1 to T2 high voltage waveform output interval, the air gap impedance drops from a near infinite level to a near zero level. This second air gap configuration is illustrated in the FIG. 5B drawing.

Once this low impedance ionized path has been established by the short duration application of the $V_{HIGH}$ output signal which resulted from the discharge of the first energy storage capacitor through the voltage multiplier, the switch controller opens switch S1 and closes switch S2 to directly connect the second energy storage capacitor across the electronic disabling device output electrodes E1 and E2. The circuit configuration for this second time interval is illustrated in the FIG. 4A block diagram. As illustrated in the FIG. 4B voltage waveform output diagram, the relatively low voltage "$V_{LOW}$" derived from the second output capacitor is now directly connected across the stun gun output terminals E1 and E2. Because the ionization of the air gap during time interval T1 to T2 dropped the air gap impedance to a low level, application of the relatively low second capacitor voltage $V_{LOW}$ across the E1 to E3 air gap during time interval T2 to T3 will allow the second energy storage capacitor to continue and maintain the previously initiated discharge across the arced-over air gap for a significant additional time interval. This continuing, lower voltage discharge of the second capacitor during the interval T2 to T3 transfers a substantial amount of target-incapacitating electrical charge through the target.

As illustrated in FIGS. 4B, 5C, 6, and 8, the continuing discharge of the second capacitor through the target will exhaust the charge stored in the capacitor and will ultimately cause the output voltage from the second capacitor to drop to a voltage level at which the ionization within the air gap will revert to the non-ionized, high impedance state causing cessation of current flow through the target.

In the FIG. 2 block diagram, the switch controller can be programmed to close switch S1 for a predetermined period of time and then to close switch S2 for a predetermined period of time to control the T1 to T2 first capacitor discharge interval and the T2 to T3 second capacitor discharge interval.

During the T3 to T4 interval, the power supply will be disabled to maintain a factory preset pulse repetition rate. As illustrated in the FIG. 8 timing diagram, this factory preset pulse repetition rate defines the overall T0 to T4 time interval. A timing control circuit potentially implemented by a microprocessor maintains switches S1 and S2 in the open condition during the T3 to T4 time interval and disables the power supply until the desired T0 to T4 time interval has been completed. At time T0, the power supply will be reactivated to recharge the first and second capacitors to the power supply output voltage.

Figure 9:
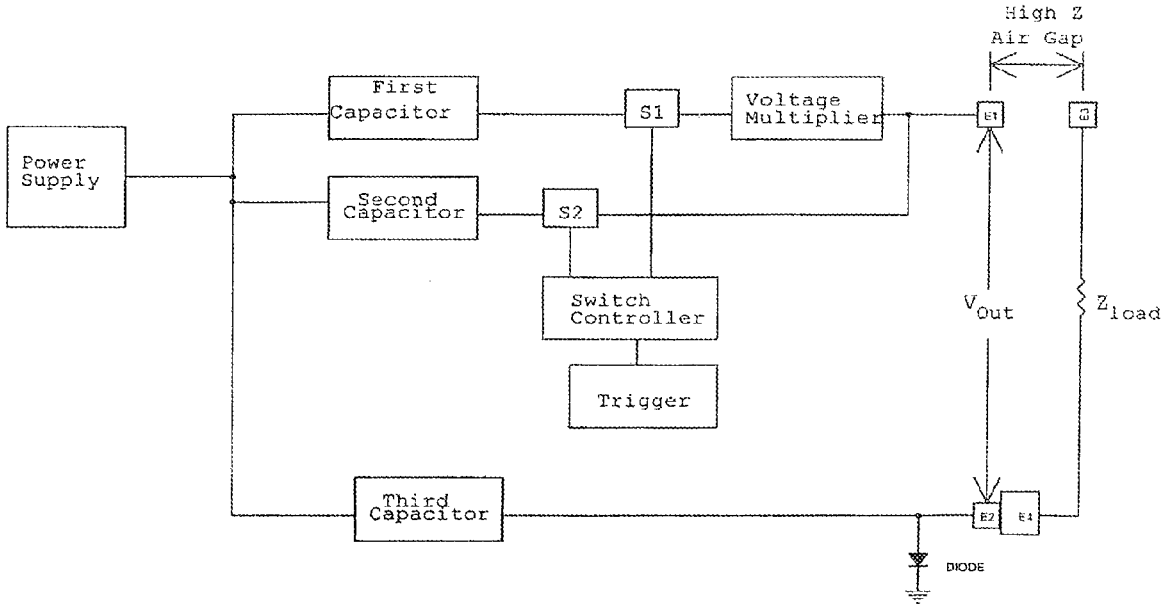
FIG. 9 represents a block diagram illustration of a more complex version of the FIG. 2 circuit where the FIG. 9 circuit includes a third capacitor.

Referring now to the FIG. 9 schematic diagram, the FIG. 2 circuit has been modified to include a third capacitor and a load diode (or resistor) connected as shown. The operation of this enhanced circuit diagram will be explained below in connection with FIG. 10 and the related more detailed schematic diagrams.

Figure 10:
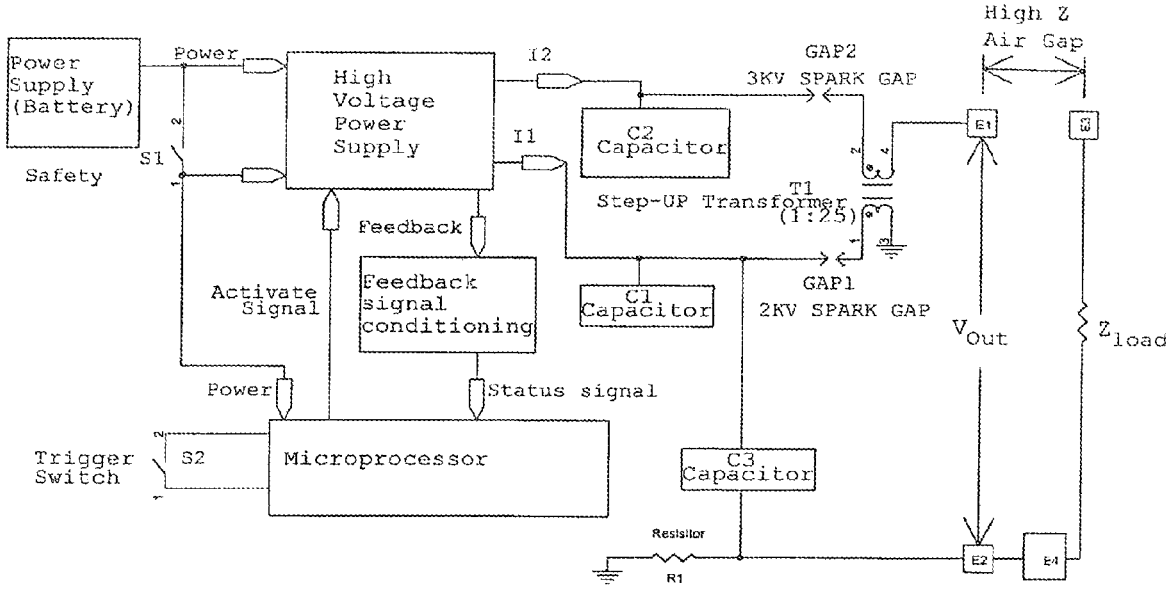
FIG. 10 represents a more detailed schematic diagram of the FIG. 9 circuit.

Referring now to the FIG. 10 electrical schematic diagram, the high voltage power supply generates an output current I1 which charges capacitors C1 and C3 in parallel. While the second terminal of capacitor C2 is connected to ground, the second terminal of capacitor C3 is connected to ground through a relatively low resistance load resistor R1 or as illustrated in FIG. 9 by a diode. The first voltage output of the high voltage power supply is also connected to a 2,000 volt spark gap designated as GAP1 and to the primary winding of an output transformer having a 1:25 primary to secondary winding step up ratio.

The second equal voltage output of the high voltage power supply is connected to one terminal of capacitor C2 while the second capacitor terminal is connected to ground. The second power supply output terminal is also connected to a 3,000 volt spark gap designated GAP2. The second side of spark gap GAP2 is connected in series with the secondary winding of transformer T1 and to stun gun output terminal E1.

In the FIG. 10 circuit, closure of safety switch S1 enables operation of the high voltage power supply and places the stun gun into a "standby/ready-to-operate" configuration. Closure of the trigger switch designated S2 causes the microprocessor to send a control signal to the high voltage power supply which activates the high voltage power supply and causes it to initiate current flow I1 into capacitors C1 and C3 and current flow I2 into capacitor C2. This capacitor charging time interval will now be explained in connection with the simplified FIG. 11 block diagram and in connection with the FIG. 12A and FIG. 12B voltage versus time graphs.

Figure 11:
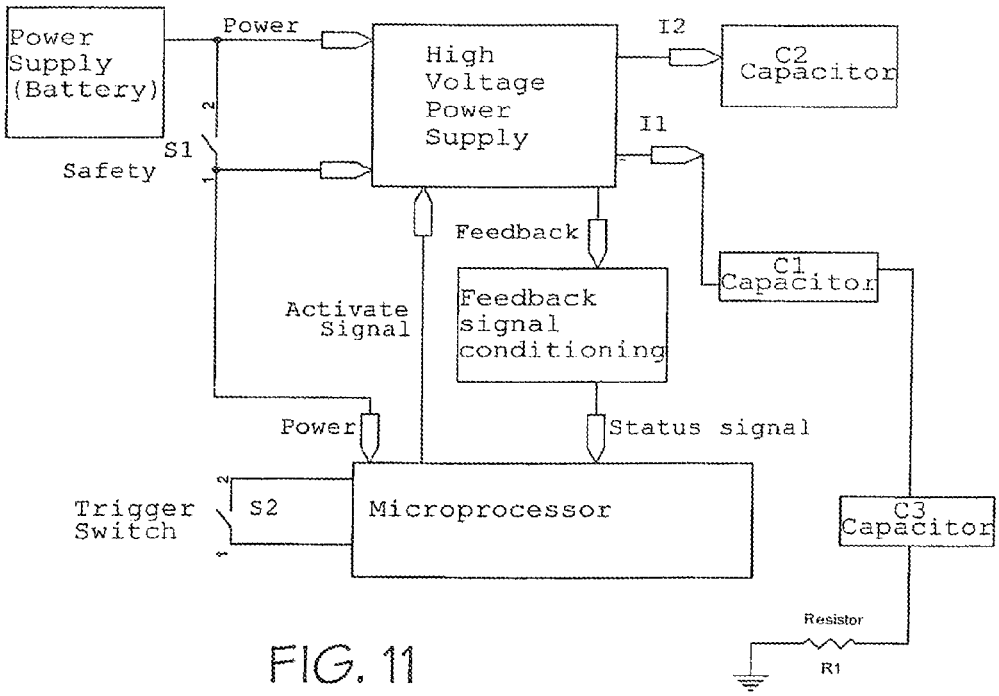
FIG. 11 represents a simplified block diagram of the FIG. 10 circuit showing the active components during time interval T0 to T1.
Figure 12A:
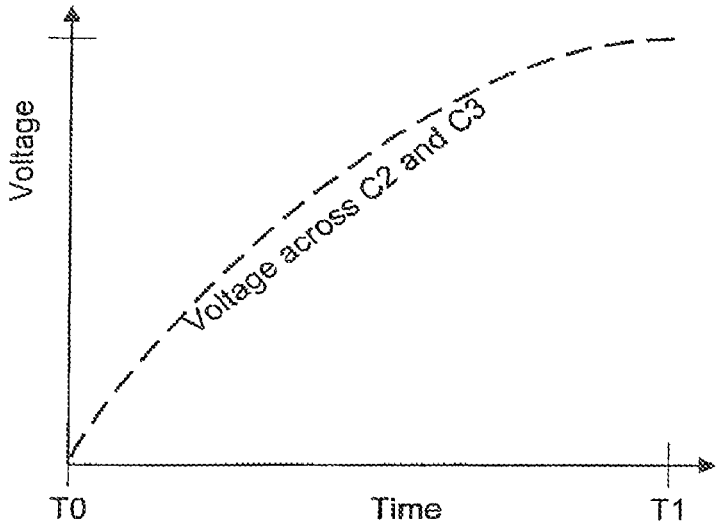
FIGS. 12A and 12B represent timing diagrams illustrating the voltages across capacitor C1, C2 and C3 during time interval T0 to T1.
Figure 12B:
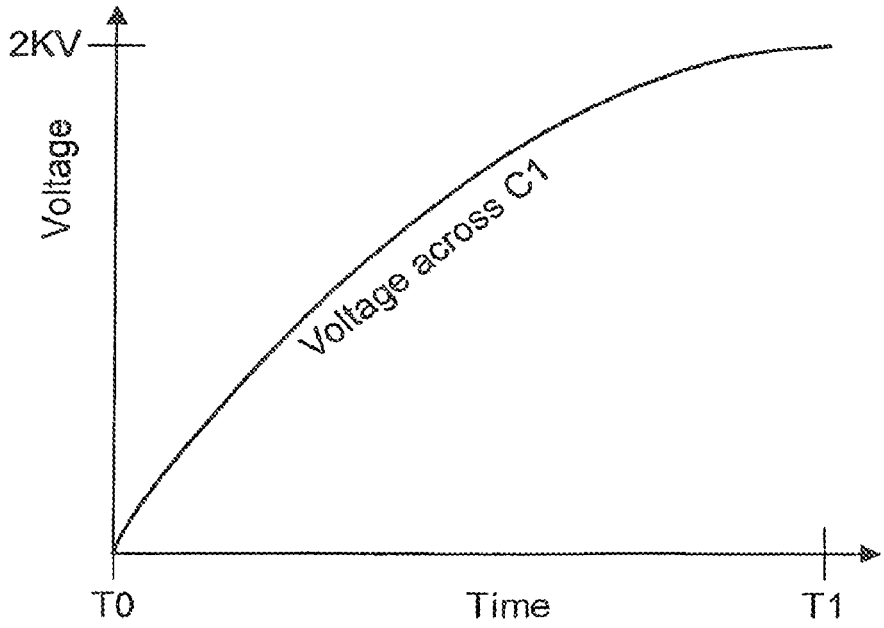

During the T0 to T1 capacitor charging interval illustrated in FIGS. 11, 12A, and 12B, capacitors C1, C2, and C3 begin charging from a zero voltage up to the 2,000 volt output generated by the high voltage power supply. Spark gaps GAP1 and GAP2 remain in the open, near infinite impedance configuration because only at the end of the T0 to T1 capacitor charging interval will the C1/C2 capacitor output voltage approach the 2,000 volt breakdown rating of GAP1.

Figure 13:
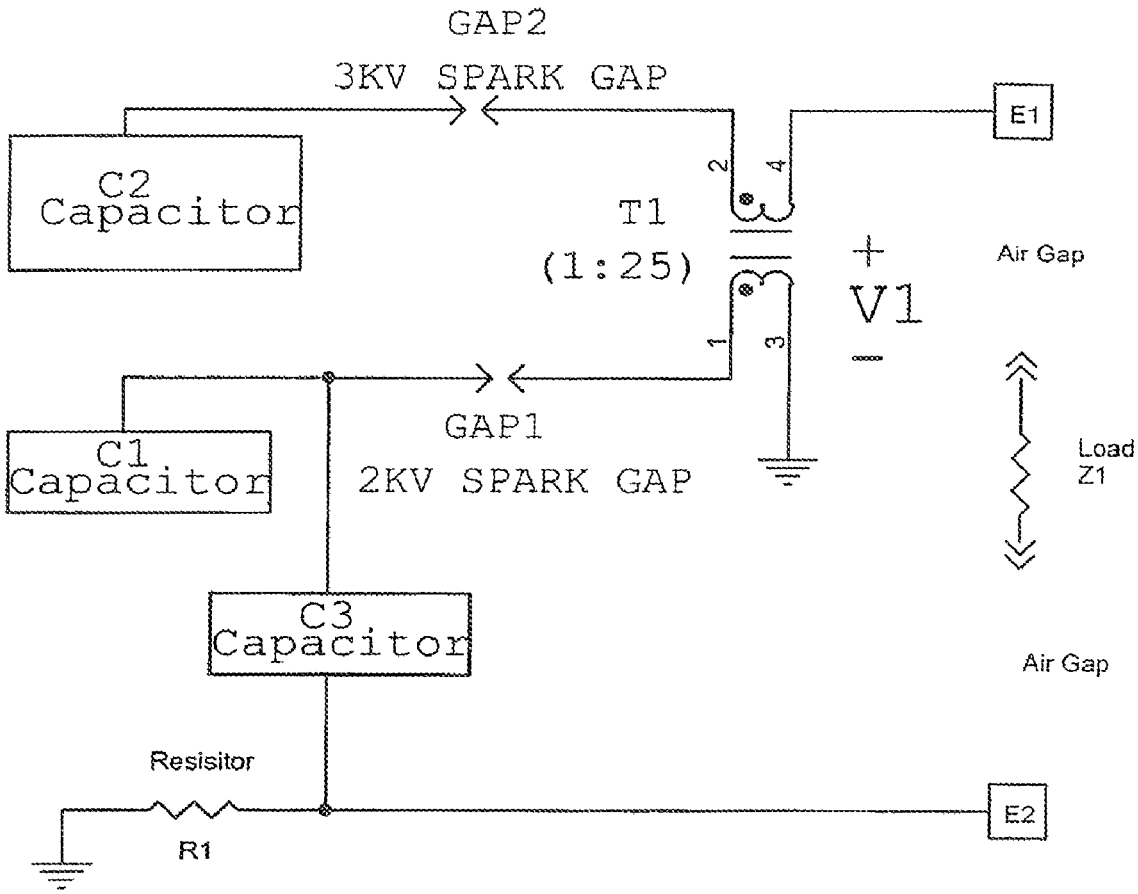
FIG. 13 illustrates the operating configuration of the FIG. 11 circuit during the T1 to T2 time interval.
Figure 14A:
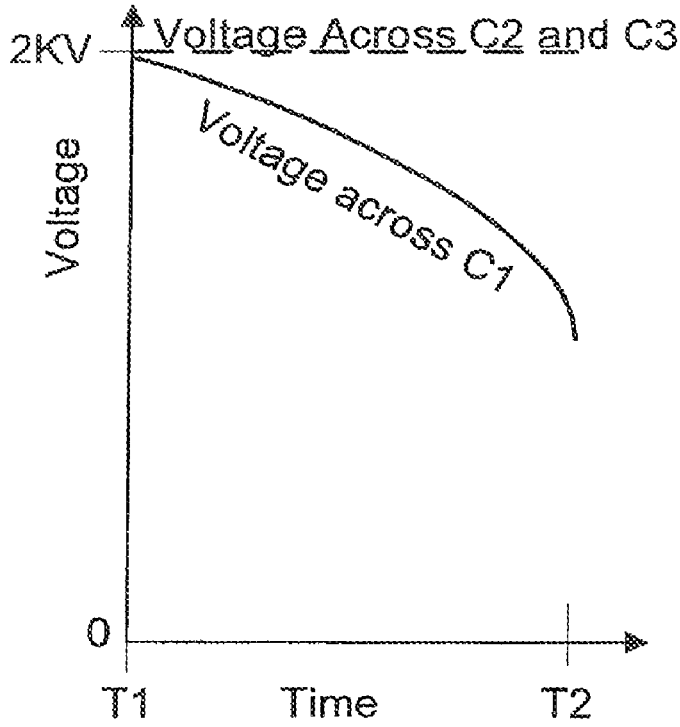
FIGS. 14A and 14B illustrate the voltages across capacitors C1, C2 and C3 during the T1 to T2 time interval.
Figure 14B:
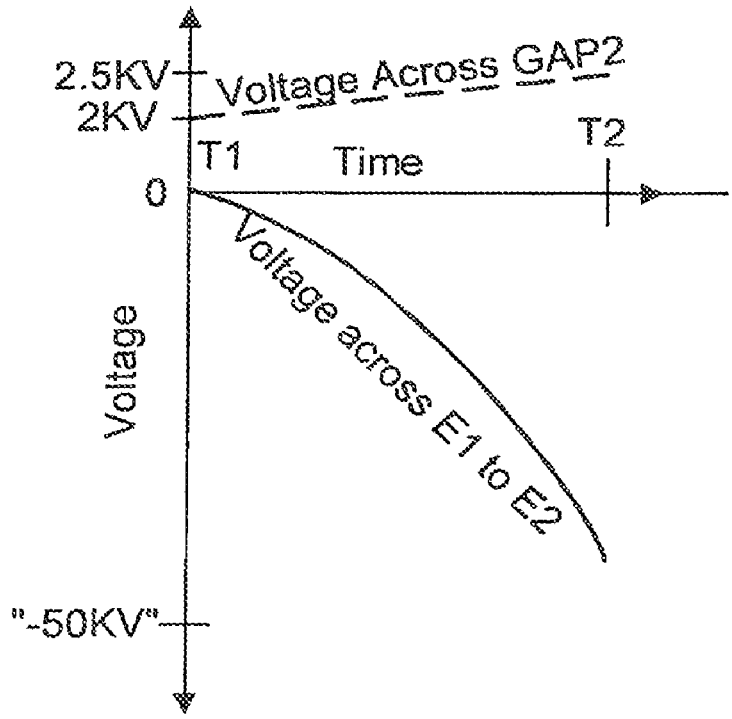

Referring now to FIGS. 13 and 14, as the voltage on capacitors C1 and C2 reaches the 2,000 volt breakdown voltage of spark gap GAP1, a spark will be formed across the spark gap and the spark gap impedance will drop to a near zero level. This transition is indicated in the FIG. 14 timing diagrams as well as in the more simplified FIG. 3B and FIG. 6 timing diagrams. Beginning at time T1, capacitor C1 will begin discharging through the primary winding of transformer T1 which will rapidly ramp up the E1 to E2 secondary winding output voltage to negative 50,000 volts as shown in FIG. 14B. FIG. 14A illustrates that the voltage across capacitor C1 relatively slowly decreases from the original 2,000 volt level while the FIG. 14B timing diagram illustrates that the multiplied voltage on the secondary winding of transformer T1 will rapidly build up during the time interval T1 to T2 to a voltage approaching minus 50,000 volts.

Figure 15:
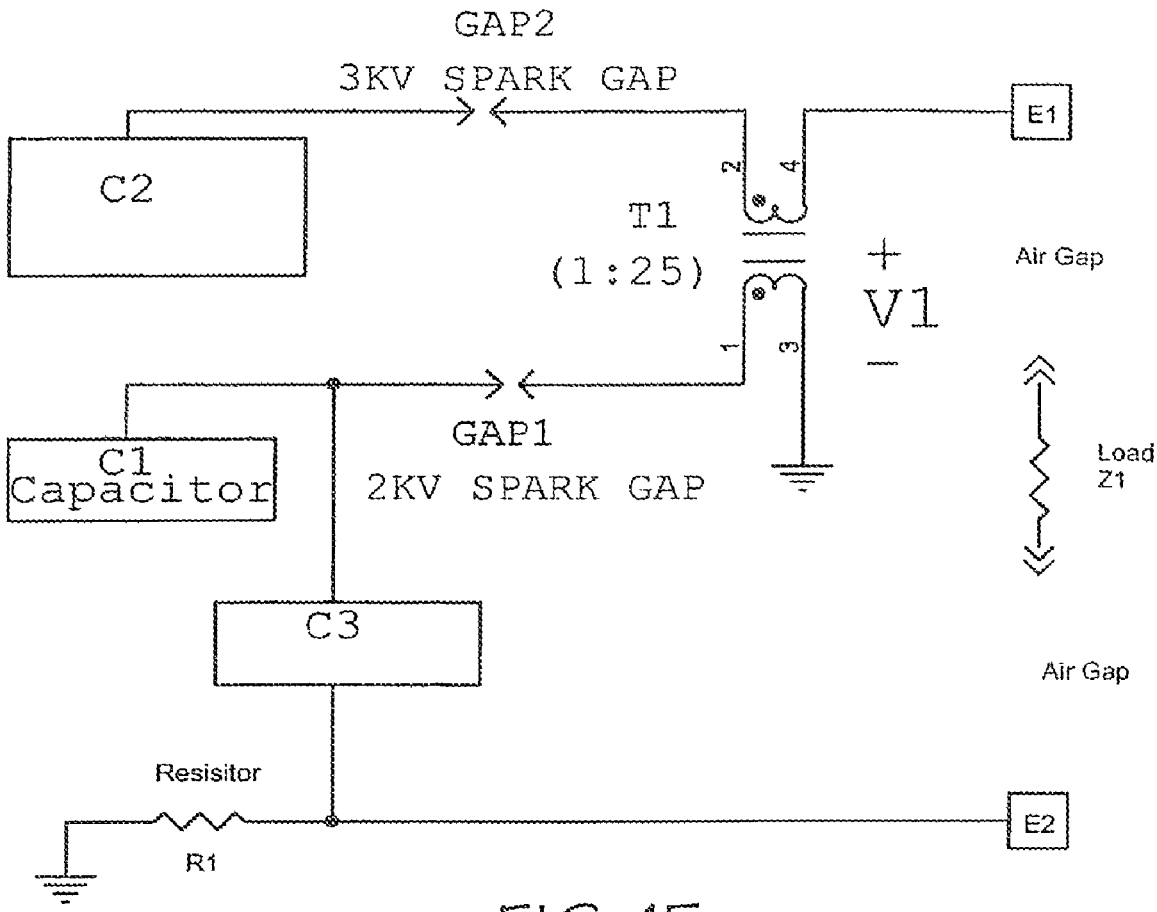
FIG. 15 represents a schematic diagram of the active components of the FIG. 10 circuit during time interval T2 to T3.
Figure 16:
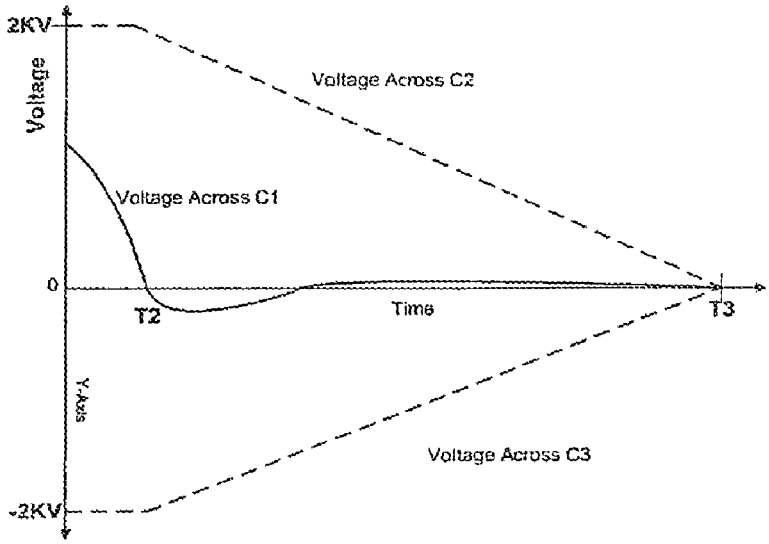
FIG. 16 illustrates the voltages across capacitors C1, C2 and C3 during time interval T2 to T3.

At the end of the T2 time interval, the FIG. 10 circuit transitions into the second configuration where the 3,000 volt spark gap GAP2 has been ionized into a near zero impedance level allowing capacitors C2 and C3 to discharge across stun gun output terminals E1 and E2 through the relatively low impedance load target. Because, as illustrated in the FIG. 16 timing diagram, the voltage across C1 will have discharged to a near zero level as time approaches T2, the FIG. 15 simplification of the FIG. 10 circuit diagram which illustrates the circuit configuration during the T2 to T3 time interval shows that capacitor C1 has effectively and functionally been taken out of the circuit. As illustrated by the FIG. 16 timing diagram, during the T2 to T3 time interval, the voltage across capacitors C2 and C3 decreases to zero as these capacitors discharge through the now low impedance (target only) load seen across output terminals E1 and E2.

Figures 17, 18:
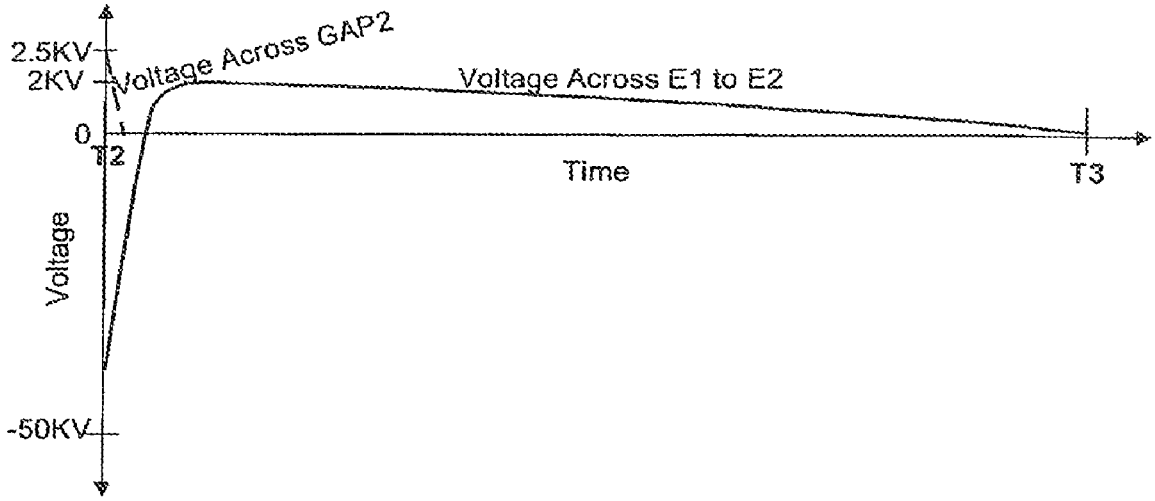
FIG. 17 illustrates the voltage levels across GAP2 and E1 to E2 during time interval T2 to T3.
FIG. 18 represents a chart indicating the effective impedance level of GAP1 and GAP2 during the various time intervals relevant to the operation of the present invention.

FIG. 17 represents another timing diagram illustrating the voltage across GAP2 and the voltage across stun gun output terminals E1 and E2 during the T2 to T3 time interval.

Figure 4B:
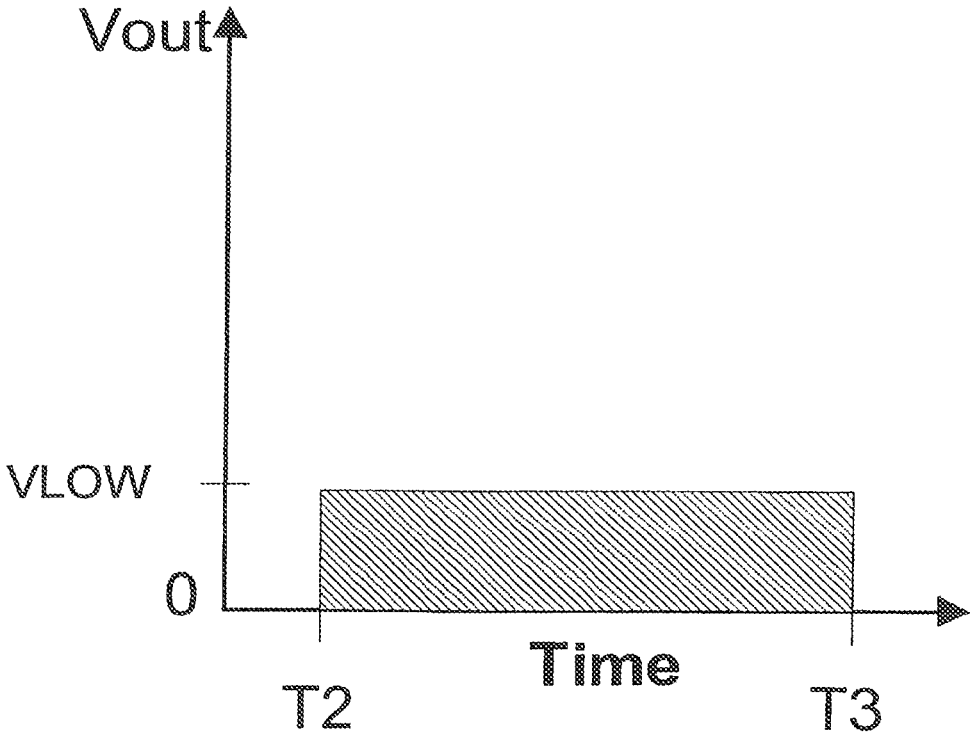
FIG. 4B represents a graph illustrating a generalized output voltage waveform for the FIG. 4A circuit element during the second time interval.
Figure 5C:
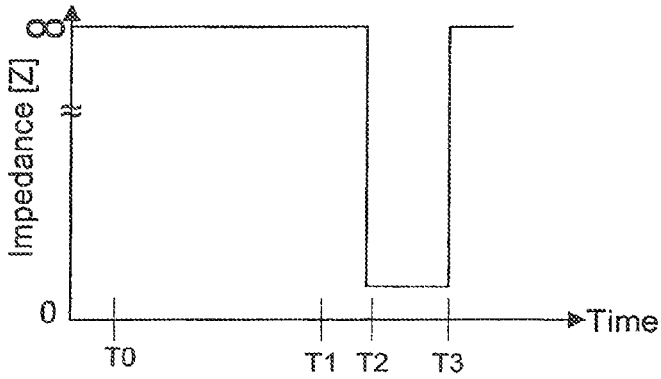
FIG. 5C represents a graph illustrating the high impedance to low impedance configuration charge across the air gap caused by transition from the FIG. 5A circuit configuration into the FIG. 5B (ionized) circuit configuration.
Figure 6:
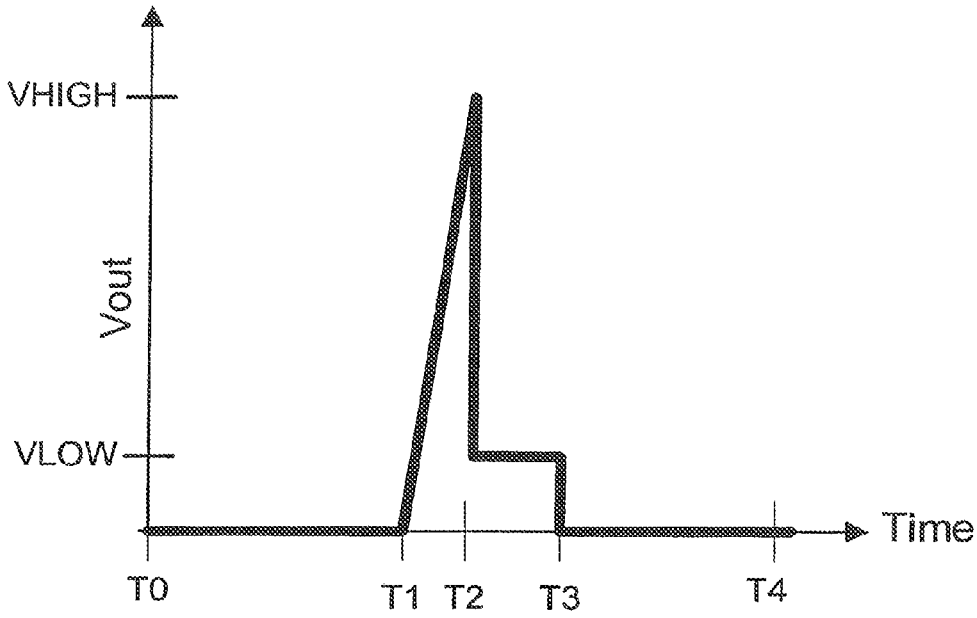
FIG. 6 illustrates a graphic representation of a plot of voltage versus time for the FIG. 2 circuit diagram.
Figure 7:
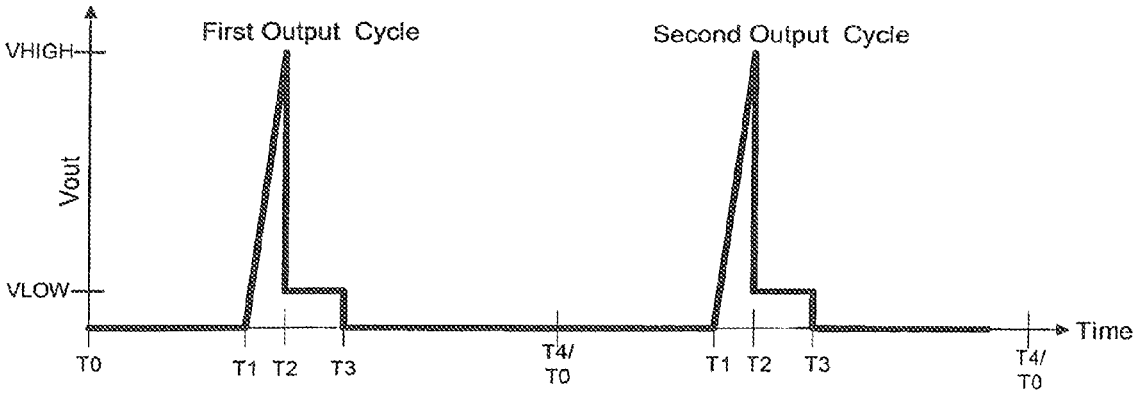
FIG. 7 illustrates a pair of sequential output pulses corresponding to two of the output pulses of the type illustrated in FIG. 6.

In one preferred embodiment of the FIG. 10 circuit, capacitor C1, the discharge of which provides the relatively high energy level required to ionize the high impedance air gap between E1 and E3, can be implemented with a capacitor rating of 0.14 microfarads and 2,000 volts. As previously discussed, capacitor C1 operates only during time interval T1 to T2 which, in this preferred embodiment, approximates on the order of 1.5 microseconds in duration. Capacitors C2 and C3 in one preferred embodiment may be selected as 0.02 microfarad capacitors for a 2,000 volt power supply voltage and operate during the T2 to T3 time interval to generate the relatively low voltage output as illustrated in FIG. 4B to maintain the current flow through the now low impedance dart-to-target air gap during the T2 to T3 time interval as illustrated in FIG. 5C. In this particular preferred embodiment, the duration of the T2 to T3 time interval approximates 50 microseconds.

Due to many variables, the duration of the T0 to T1 time interval may change. For example, a fresh battery may shorten the T0 to T1 time interval in comparison to circuit operation with a partially discharged battery. Similarly, operation of the stun gun in cold weather which degrades battery capacity might also increase the T0 to T1 time interval.

Figure 8:
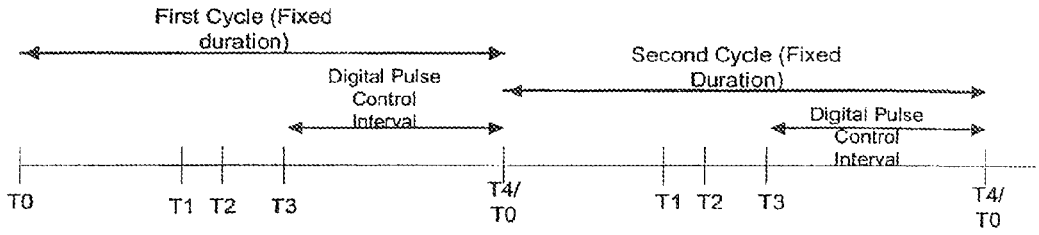
FIG. 8 illustrates a sequence of two output pulses.

Since it is highly desirable to operate stun guns with a fixed pulse repetition rate as illustrated in the FIG. 8 timing diagram, the circuit of the present invention provides a microprocessor-implemented digital pulse control interval designated as the T3 to T4 interval in FIG. 8. As illustrated in the FIG. 10 block diagram, the microprocessor receives a feedback signal from the high voltage power supply via a feedback signal conditioning element which provides a circuit operating status signal to the microprocessor. The microprocessor is thus able to detect when time T3 has been reached as illustrated in the FIG. 6 timing diagram and in the FIG. 8 timing diagram. Since the commencement time T0 of the operating cycle is known, the microprocessor will maintain the high voltage power supply in a shut down or disabled operating mode from T3 until the factory preset pulse repetition rate defined by the T0 to T4 time interval has been achieved. While the duration of the T3 to T4 time interval will vary, the microprocessor will maintain the T0 to T4 time interval constant.

The FIG. 18 table entitled "Gap On/Off Timing" represents a simplified summary of the configuration of GAP1 and GAP2 during the four relevant operating time intervals. The configuration "off" represents the high impedance, non-ionized spark gap state while the configuration "on" represents the ionized state where the spark gap breakdown voltage has been reached.

Figure 19:
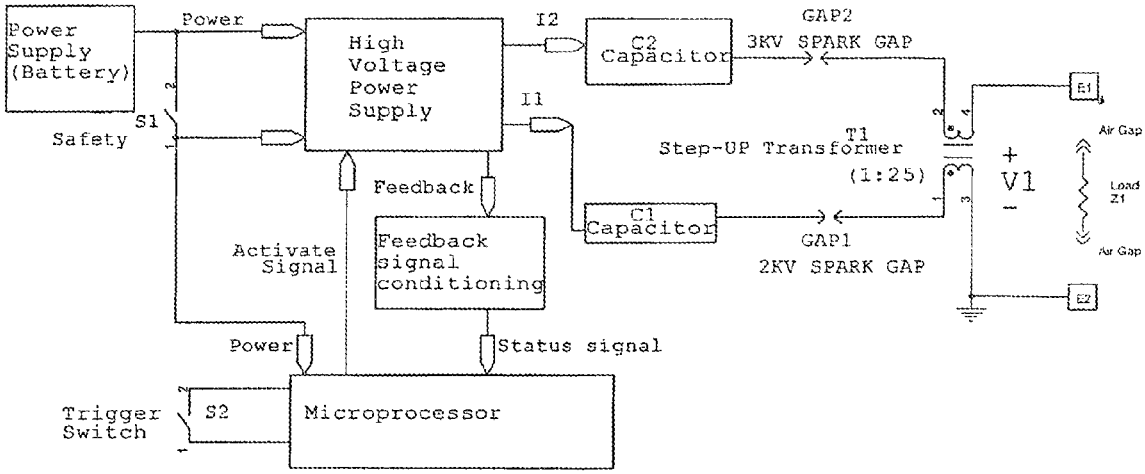
FIG. 19 represents an alternative embodiment of the invention which includes only a pair of output capacitors C1 and C2.

FIG. 19 represents a simplified block diagram of a circuit analogous to the FIG. 10 circuit except that the circuit has been simplified to include only capacitors C1 and C2. The FIG. 19 circuit is capable of operating in a highly efficient or "tuned" dual mode configuration according to the teachings of the present invention.

Figure 20:
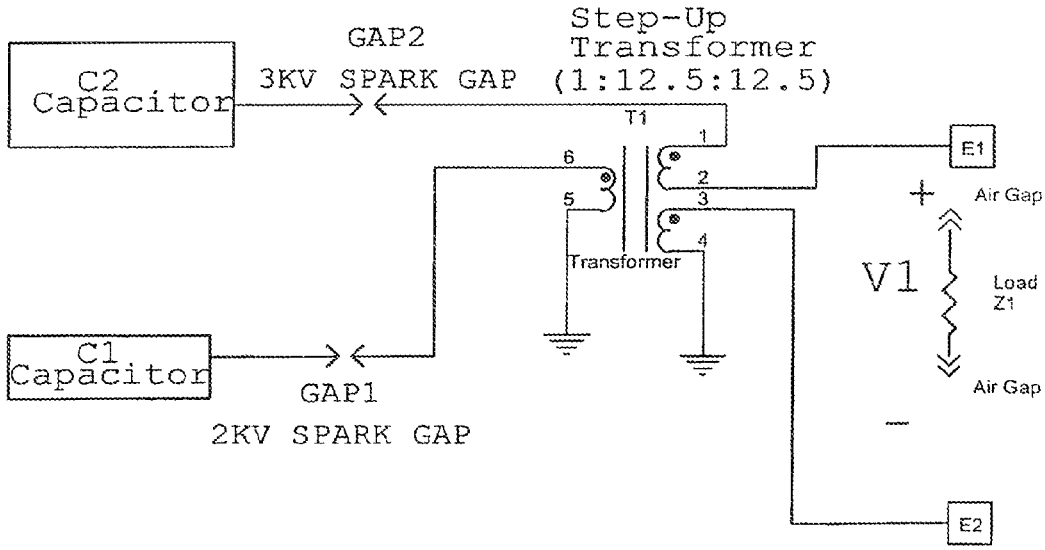
FIG. 20 represents another embodiment of the invention including an alternative output transformer designer having a single primary winding and a pair of secondary windings.

FIG. 20 illustrates an alternative configuration for coupling capacitors C1 and C2 to the stun gun output electrodes E1 and E2 via an output transformer having a single primary winding and a center-tapped or two separate secondary windings. The step up ratio relative to each primary winding and each secondary winding represents a ratio of 1:12.5. This modified output transformer still accomplishes the objective of achieving a 1:25 step-up ratio for generating an approximate 50,000 volt signal with a 2,000 volt power supply rating. One advantage of this double secondary transformer configuration is that the maximum voltage applied to each secondary winding is reduced by 50%. Such reduced secondary winding operating potentials may be desired in certain conditions to achieve a higher output voltage with a given amount of transformer insulation or for placing less high voltage stress on the elements of the output transformer.

Figure 1:
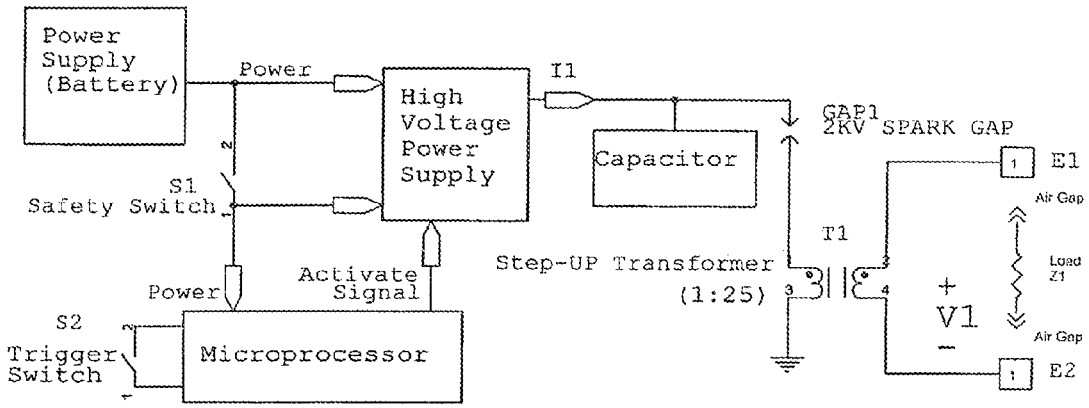
(Related Art) FIG. 1
FIG. 1 illustrates a high performance prior art stun gun circuit.

Substantial and impressive benefits may be achieved by using the electronic disabling device of the present invention which provides for dual mode operation to generate a time-sequenced, shaped voltage output waveform in comparison to the most advanced prior art stun gun represented by the Taser M26 stun gun as illustrated and described in connection with the FIG. 1 block diagram.

The Taser M26 stun gun utilizes a single energy storage capacitor having a 0.88 microfarad capacitance rating. When charged to 2,000 volts, that 0.88 microfarad energy storage capacitor stores and subsequently discharges 1.76 joules of energy during each output pulse. For a standard pulse repetition rate of 15 pulses per second with an output of 1.76 joules per discharge pulse, the Taser M26 stun gun requires around 35 watts of input power which, as explained above, must be provided by a large, relatively heavy battery power supply utilizing 8 series-connected AA alkaline battery cells.

For one embodiment of the electronic disabling device of the present invention which generates a time-sequenced, shaped voltage output waveform and with a C1 capacitor having a rating of 0.07 microfarads and a single capacitor C2 with a capacitance of 0.01 microfarads (for a combined rating of 0.08 microfarads), each pulse repetition consumes only 0.16 joules of energy. With a pulse repetition rate of 15 pulses per second, the two capacitors consume battery power of only 2.4 watts at the capacitors (roughly 3.5 to 4 watts at the battery), a 90% reduction, compared to the 26 watts consumed by the state of the art Taser M26 stun gun. As a result, this particular configuration of the electronic disabling device of the present invention which generates a time-sequenced, shaped voltage output waveform can readily operate with only a single AA battery due to its 2.4 watt power consumption.

Figure 3A:
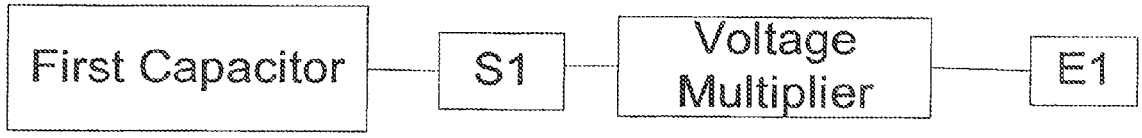
FIG. 3A represents a block diagram illustration of a first segment of the system block diagram illustrated in FIG. 2 which functions during a first time interval.
Figure 3B:
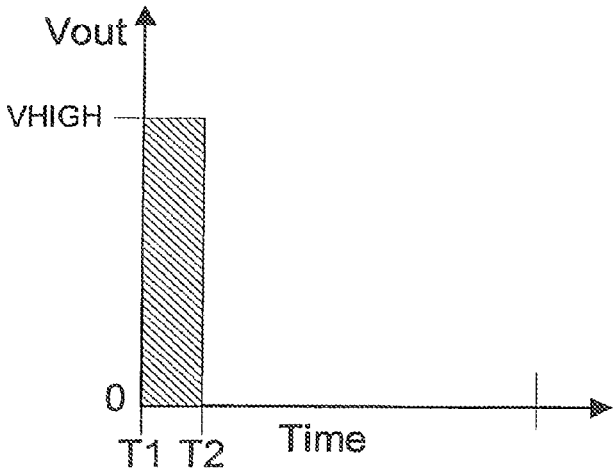
FIG. 3B represents a graph illustrating a generalized output voltage waveform of the circuit element shown in FIG. 3A.

Because the electronic disabling device of the present invention generates a time-sequenced, shaped voltage output waveform as illustrated in the FIGS. 3B and 4B timing diagrams, the output waveform of this invention is tuned to most efficiently accommodate the two different load configurations presented: a high voltage output operating mode during the high impedance T1 to T2 first operating interval; and, a relatively low voltage output operating mode during the low impedance second T2 to T3 operating interval.

Figure 4A:
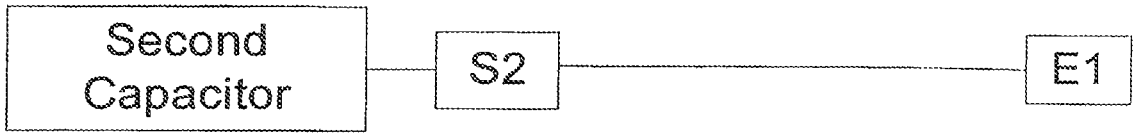
FIG. 4A illustrates a second element of the FIG. 2 system block diagram which operates during a second time interval.

As illustrated in the FIG. 5C timing diagram and in the FIGS. 2, 3A, and 4A simplified schematic diagrams, the circuit of the present invention is selectively configured into a first operating configuration during the T1 to T2 time interval where a first capacitor operates in conjunction with a voltage multiplier to generate a very high voltage output signal sufficient to breakdown the high impedance target-related air gap as illustrated in FIG. 5A. Once that air gap has been transformed into a low impedance configuration as illustrated in the FIG. 5C timing diagram, the circuit is selectively reconfigured into the FIG. 3A second configuration where a second or a second and a third capacitor discharge a substantial amount of current through the now low impedance target load (typically 1,000 ohms or less) to thereby transfer a substantial amount of electrical charge through the target to cause massive disruption of the target's neurological control system to maximize target incapacitation.

Accordingly, the electronic disabling device of the present invention which generates a time-sequenced, shaped voltage output waveform is automatically tuned to operate in a first circuit configuration during a first time interval to generate an optimized waveform for attacking and eliminating the otherwise blocking high impedance air gap and is then retuned to subsequently operate in a second circuit configuration to operate during a second time interval at a second much lower optimized voltage level to efficiently maximize the incapacitation effect on the target's skeletal muscles. As a result, the target incapacitation capacity of the present invention is maximized while the stun gun power consumption is minimized.

As an additional benefit, the circuit elements operate at lower power levels and lower stress levels resulting in either more reliable circuit operation and can be packaged in a much more physically compact design. In a laboratory prototype embodiment of a stun gun incorporating the present invention, the prototype size in comparison to the size of present state of the art Taser M26 stun gun has been reduced by approximately 50% and the weight has been reduced by approximately 60%.

It will be apparent to those skilled in the art that the disclosed electronic disabling device for generating a time-sequenced, shaped voltage output waveform may be modified in numerous ways and may assume many embodiments other than the preferred forms specifically set out and described above. Accordingly, it is intended that the appended claims cover all such modifications of the invention which fall within the true spirit and scope of the invention.

What is claimed is:

1. An apparatus for producing contractions in skeletal muscles of a target to impede locomotion by the target, the apparatus for use with at least one provided electrode for conducting a current through the target, the apparatus comprising:

a first circuit comprising a transformer and a first capacitor, the first capacitor having a first voltage across the first capacitor; and a series circuit during discharging of a second capacitor, the series circuit comprising the second capacitor and a secondary winding of the transformer; wherein in operation with the electrode, the transformer impresses a voltage on the electrode of greater magnitude than the first voltage, the electrode is in series with the series circuit, and the current is responsive to discharge of the first capacitor and discharge of the second capacitor.

2. The apparatus of claim 1 wherein the first capacitor has a capacity greater than a capacity of the second capacitor.

3. The apparatus of claim 1 wherein the first capacitor has a capacity of about 0.07 microfarads.

4. The apparatus of claim 1 wherein the second capacitor has a capacity of about 0.01 microfarads.

5. The apparatus of claim 1 wherein a ratio of capacities of the first capacitor to the second capacitor is about 7.

6. The apparatus of claim 1 wherein:

the current comprises a pulse; and a sum of energy stored on the first capacitor and energy stored on the second capacitor for release by discharging during the pulse is about 0.16 joules.

7. The apparatus of claim 1 wherein a first duration for discharging the first capacitor is less than a second duration for discharging the second capacitor.

8. The apparatus of claim 7 wherein the first duration is about 1.5 microseconds.

9. The apparatus of claim 7 wherein the second duration is about 50 microseconds.

10. The apparatus of claim 1 wherein the first circuit further comprises a switch that is open during a first period and closed during a second period, wherein the first capacitor charges during the first period and discharges during the second period.

11. The apparatus of claim 10 wherein the first period ends in response to the first voltage reaching a predetermined magnitude.

12. The apparatus of claim 10 wherein the switch comprises a spark gap.

13. The apparatus of claim 1 wherein the series circuit further comprises a switch that is open during a first period and closed during a second period, wherein the second capacitor charges during the first period and discharges during the second period.

14. The apparatus of claim 13 wherein the first period ends in response to the first voltage reaching a predetermined magnitude.

15. The apparatus of claim 13 wherein the switch comprises a spark gap.

16. The apparatus of claim 1 wherein:

the first circuit further comprises a first spark gap having a first break-over voltage;

the series circuit further comprises a second spark gap having a second break-over voltage; and the second break-over voltage is greater than the first break-over voltage.

17. The apparatus of claim 1 further for use with a second provided electrode, wherein the transformer further comprises a second secondary winding that in operation is coupled to the second electrode.

* * * * *

UNITED STATES PATENT AND TRADEMARK OFFICE

CERTIFICATE OF CORRECTION

PATENT NO. : 7,602,598 B2
APPLICATION NO. : 11/566481
DATED : October 13, 2009
INVENTOR(S) : Magne H. Nerheim It is certified that error appears in the above-identified patent and that said Letters Patent is hereby corrected as shown below:

Title Pg, Item (57), under "ABSTRACT", in column 2, line 12,
after "to" insert -- discharge of --.

In column 6, line 35, delete "flow 12" and insert -- flow I2 --, therefor.

Signed and Sealed this
Fourth Day of October, 2011

David J. Kappos

David J. Kappos
*Director of the United States Patent and Trademark Office*